US008851752B2

(12) United States Patent
Wichmann

(10) Patent No.: US 8,851,752 B2
(45) Date of Patent: Oct. 7, 2014

(54) BAG WITH A BAG WALL DESIGNED TO DISSOLVE IN A MOIST ENVIRONMENT AND USE OF THE BAG AS A CEMENT BAG

(75) Inventor: Hans-Joachim Wichmann, Sendenhorst (DE)

(73) Assignee: Mondi AG, Vienna (AT)

( * ) Notice: Subject to any disclaimer, the term of this patent is extended or adjusted under 35 U.S.C. 154(b) by 128 days.

(21) Appl. No.: 13/170,323

(22) Filed: Jun. 28, 2011

(65) Prior Publication Data

US 2011/0315272 A1 Dec. 29, 2011
US 2012/0199243 A2 Aug. 9, 2012

(30) Foreign Application Priority Data

Jun. 28, 2010 (DE) ..... 10 2010 026 241

(51) Int. Cl.

| | |
|---|---|
| ***B65D 30/02*** | (2006.01) |
| ***B65D 30/24*** | (2006.01) |
| ***B65D 30/08*** | (2006.01) |
| ***B65D 30/12*** | (2006.01) |
| ***B28C 5/00*** | (2006.01) |
| ***E04C 5/07*** | (2006.01) |
| ***B65D 65/46*** | (2006.01) |

(52) U.S. Cl.
CPC ..... *B65D 31/142* (2013.01); *E04C 5/076* (2013.01); *B65D 65/46* (2013.01)
USPC ..... 383/1; 383/44; 383/109; 383/125; 366/2

(58) Field of Classification Search
CPC ..... C04B 40/0028; B65D 65/46
USPC ..... 383/1, 44, 125, 126, 109; 366/2
See application file for complete search history.

(56) References Cited

U.S. PATENT DOCUMENTS

| | | | | |
|---|---|---|---|---|
| 1,933,776 | A * | 11/1933 | Tooker | 383/98 |
| 2,776,084 | A * | 1/1957 | Williams | 383/109 |
| 3,058,647 | A * | 10/1962 | Reiselt | 383/109 |
| 3,203,620 | A | 8/1965 | Becker | |
| 3,220,601 | A * | 11/1965 | Kasting | 383/54 |
| 3,473,446 | A * | 10/1969 | Berghgracht | 493/232 |
| 3,591,072 | A * | 7/1971 | Sannino | 383/54 |

(Continued)

FOREIGN PATENT DOCUMENTS

| | | |
|---|---|---|
| CA | 1 163 964 | 3/1984 |
| DE | 28 20 320 C2 | 2/1979 |

(Continued)

OTHER PUBLICATIONS

European Search Report dated Oct. 20, 2011.

*Primary Examiner* — Jes F Pascua
(74) *Attorney, Agent, or Firm* — Whitham Curtis Christofferson & Cook, PC

(57) ABSTRACT

A bag, consisting of a single-layer or multi-layer bag wall, which is bonded to form a tube (1) and, at least at one end, has a bottom (4) which is suitable for filling with charge through a filler of a bag-filling machine, is folded and bonded and is realized with a valve opening (13), and said bag wall being designed to dissolve in a moist environment thereby releasing the charge, makes complete dissolving of the bag wall (2) possible even in the region of the bottom (4) which is provided with the valve opening (13), characterized in that the bonding of the bottom (4) is effected using a dextrin adhesive.

7 Claims, 1 Drawing Sheet

(56) References Cited

U.S. PATENT DOCUMENTS

| | | | | | |
|---|---|---|---|---|---|
| 3,632,039 | A | * | 1/1972 | Gayle | 206/525 |
| 4,188,304 | A | * | 2/1980 | Clarke et al. | 510/296 |
| 5,224,595 | A | * | 7/1993 | Sugimoto et al. | 206/321 |
| 5,932,639 | A | * | 8/1999 | Eden et al. | 524/48 |
| 6,883,964 | B2 | | 4/2005 | Beaulieu | |
| 7,469,519 | B2 | * | 12/2008 | Barthel et al. | 53/433 |
| 2010/0008603 | A1 | | 1/2010 | Smith et al. | |

FOREIGN PATENT DOCUMENTS

| | | | | | |
|---|---|---|---|---|---|
| DE | 20 2008 003 172 | U | | 6/2008 | |
| EP | 246 897 | A2 | | 11/1987 | |
| EP | 1 914 173 | | | 10/2007 | |
| GB | 1 559 667 | | | 1/1980 | |
| GB | 2 448 486 | A | | 10/2008 | |
| JP | 10258845 | A | * | 9/1998 | B65D 30/02 |
| WO | 97/46376 | | | 12/1997 | |
| WO | WO 2004052746 | A1 | * | 6/2004 | B65D 65/46 |

* cited by examiner

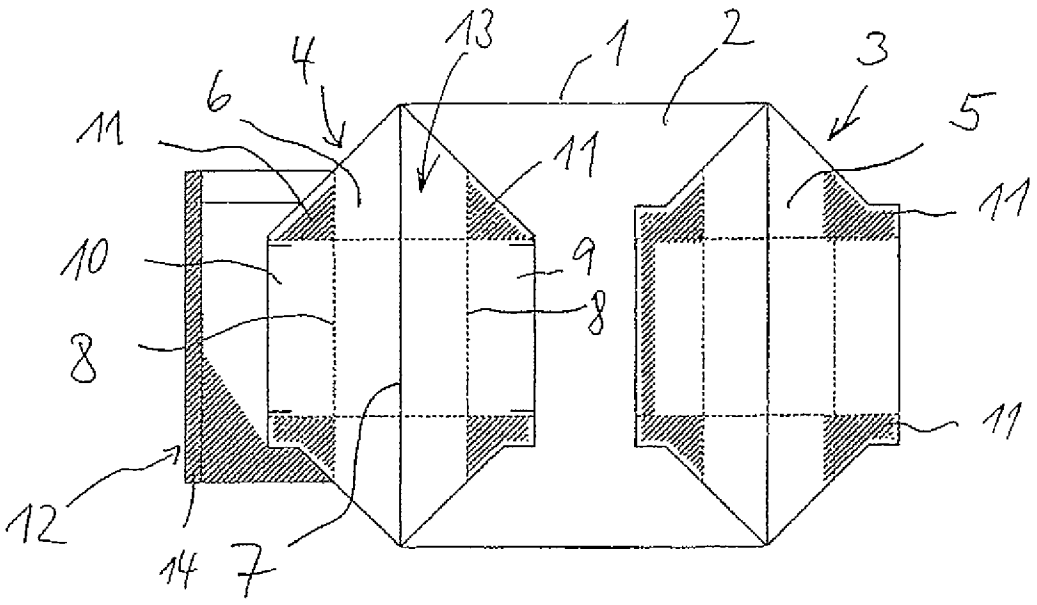
11
5
3
2
1
13
4
6
11
11
10
8
12
14
7
9
8
11

BAG WITH A BAG WALL DESIGNED TO DISSOLVE IN A MOIST ENVIRONMENT AND USE OF THE BAG AS A CEMENT BAG

FIELD OF THE INVENTION

The invention relates to a bag, consisting of a single-layer or multi-layer bag wall, which is bonded to form a tube and, at least at one end, has a bottom which is suitable for filling with charge through a filler of a bag-filling machine, is folded and bonded and is realized with a valve opening, and said bag wall being designed to dissolve in a moist environment thereby releasing the charge.

The invention relates in particular to the use of a bag of this type as a cement bag, where the dissolving of the bag wall is effected in a concrete mixing machine with water and sand and preferably gravel as aggregates.

BACKGROUND

Bags which can be filled with a dry charge by means of a bag-filling machine have been known for a long time. The charge is intended to be mixed with moist materials at a site of use in order, in this manner, to obtain a hardening compound, for example concrete. To this end, the bag, formed as a valve bag, is cut open at its top end and the dry charge that gives off dust is poured into a mixing device in which it is processed to form a moist mixture, which hardens when the mixing operation is concluded. An example of such a charge is cement which is processed in a concrete mixing machine or concrete mixing plant with water, sand and where applicable gravel to form a slightly moist mortar mixture which is castable on site, generally speaking on a building site, into a formwork and hardens there in order to form, for example, a concrete support, a concrete wall or the like.

Pouring the dry and dusty charge into the mixing device in this case causes problems because part of the charge presents as dust. This is unpleasant for the operator not only on account of the dirt linked thereto but also because it is also potentially hazardous to health.

Consequently, the idea arose to design a bag of this type with a bag wall that dissolves in a moist environment so that the bag with the charge can be thrown into the mixing device unopened. Once the bag wall has dissolved, the charge is available as the required cement in order to produce the mortar mixture. In so far as the bag wall, which is formed from water-soluble paper, dissolves completely, the (paper) material of the wall is not detrimental to the forming of the concrete. The opening of the bag and the pouring out of the charge into the mixing device leading inevitably to the charge presenting as dust could, consequently, be avoided with this method.

However, it has been shown that with normal mixing times of a few minutes, it is not possible to achieve complete dissolution of the bag wall, but rather pieces of bag wall of not insignificant size remain in the mixture. This is unacceptable as the remaining pieces from the material of the bag wall, that is to say in particular pieces of paper, impede the stable concrete bond and thus cause weak points in the concrete component. Consequently, a solution that is acceptable in practice for a bag that dissolves completely in a moist environment within a mixing device has not yet been found.

SUMMARY

The object underlying the present invention is to produce a bag of the aforementioned type so that under the usual mixing conditions and at usual mixing times, as provided for example in a concrete mixing device, said bag dissolves completely such that the concrete mixture produced can be produced in a fault-free manner without any troublesome undissolved remains of the material of the bag wall.

To achieve this object, a bag of the aforementioned type is characterized in that the bonding of the bottom is effected using a dextrin adhesive. The dextrin adhesive consists, in particular, of maltodextrin having a dextrose equivalent of between 4.5 and 8.5.

Bags that are suitable for filling by means of a bag-filling machine are generally closed by way of cross bottoms. The bottom having the valve opening is realized, in particular, as the cross bottom. Of necessity, numerous layers of the bag wall have to be placed on top of each other and bonded to each other on a bottom of this type. Tests with a fluorescent adhesive have shown that the undissolved parts of the bag wall are, in particular, those parts that have several layers connected together by adhesive. Consequently, it is particularly important to use an adhesive that is water-soluble.

However, the success striven for according to the invention is not achieved with usual water-soluble adhesives, as after a usual maximum mixing time of 5 minutes, for example in a concrete mixing machine, complete dissolution of the material of the bag wall is still not achieved.

It has been found in a surprising manner that complete dissolution of the bag wall for practical demands is achieved when the bonding of the bottom is effected using a dextrin adhesive that is used as a foodstuff adhesive, in particular maltodextrin having a dextrose equivalent of between 4.5 and 8.5.

A dextrin adhesive of this type has not yet been used for the bonding, in particular the bottom bonding, of paper layers of a bag. The characteristic of the adhesive according to the invention is that it dissolves very rapidly even in a slightly moist environment and releases the adjacent layers of the bag wall such that, as individual layers, they are subject to rapid dissolution in an at least slightly moist environment.

Consequently, the solution to the problem, according to the invention, does not provide an improvement in the material of the bag wall, but rather by using a special adhesive, at least for the bonding of the bottom, provides a rapid separation of the parts of the bag wall bonded together to form the bottom such that even these parts, like the remaining bag wall outside the bottom, are exposed to rapid and complete dissolution in the at least slightly moist environment.

In a preferred embodiment of the invention, the dissolving of the bag succeeds in a particularly good manner even in the region of the folded and bonded bottoms by the bottom flaps, placed on top of each other for folding the bottom, overlapping only a little, preferably by a maximum of 2 cm, in a particularly preferred manner by a maximum of 1 cm.

A valve bottom folded according to EP 1 914 173 B1 is particularly well suited for forming a cross bottom with a valve opening. In the case of this bottom, the bottom flaps preferably overlap by a maximum of 1 cm, in a particularly preferred manner the bottom flaps do not overlap at all, but rather connect to each other thereby forming a possible narrow slot. The sealing of the bag is effected in the region of the bottom flaps by way of a glued-on bottom cover sheet. The valve opening into which the fill tube of a bag-filling machine can enter at the side, in this case, is formed between the bottom flaps and the bottom cover sheet. The inserting of the fill tube causes the bottom flaps to be pressed towards the interior of the bag and a slot, widened thereby, to be exposed, the slot being used to conduct the charge through the fill tube into the interior of the bag. Once the bag has been filled, the charge presses the bottom flaps against each other again or against the bottom cover sheet, as a result of which the bag is closed sufficiently through the weight of the charge.

In another preferred embodiment, the bottom flaps overlap above a corner tuck of the bottom by a maximum of 2 cm, the valve opening being formed between the bottom flaps and the corner tuck.

For the present invention, the valve opening is preferably formed without a folded valve sheet that is otherwise usual.

Minimizing the application of the adhesive can be achieved in the case of the bottom structures according to the invention in that the width of the bottom cover sheet is greater than that of the folded bottom and said bottom cover sheet extends, at least at one end, over a long bottom fold line to the adjacent bag wall. This means that the bottom structure is stabilized using a small amount of the adhesive. The adhesion of the bottom cover sheet to the adjacent bag wall—on the other side of the bottom fold line when seen from the bottom—results in the application of the adhesive for the forming of the bottom also being distributed onto the adjacent bag wall, which means that there is a reduction in an adhesive concentration which is detrimental to the dissolving process and by means of which several layers of the bag are initially built up.

Regarding the material of the bag wall, it is simply important that it dissolves easily in a moist environment. Accordingly, the bag wall can consist of one or more layers of a paper that is easily soluble in water. Said paper is preferably not sized and contains only a small amount of starch. Over and above this, the bag wall can also contain a water-soluble foil, that is to say can consist of at least one layer of paper and at least one layer of the water-soluble foil. In addition, it is possible to form the bag wall exclusively from a water-soluble foil. In all cases, it is expedient when, for the printing of the bag wall, care is taken to ensure that a water-soluble dye is used, as otherwise a non water-soluble dye could make it more difficult to dissolve the bag wall in the region printed on with the dye or could prevent it.

The bag according to the invention is preferably used as a cement bag, the bag wall of which is dissolved in a concrete mixing machine with water and sand as aggregates. It has been shown that the dissolving of the bag wall is further supported by gravel being used as an aggregate for the concrete as well as sand. Perfect dissolving of the bag wall and the producing of a fault-free concrete part is achievable in particular for this application.

DESCRIPTION OF THE DRAWINGS

The invention is to be explained in more detail below by way of an exemplary embodiment represented in the drawing.

The single drawing FIGURE shows a bag wall that has been bonded to form a tube, where corner tucks have been performed for forming cross bottoms at both ends of the tube.

DESCRIPTION

Consequently, the drawing shows a tube 1 of a bag wall 2 laid flat, where a lower layer and an upper layer are consequently laid one on top of the other. The bag produced from the tube 1 is closed off in each case at the top and bottom by way of a bottom 3, 4. Both bottoms are realized as cross bottoms.

The cross bottoms are realized in the usual manner by corner tucks 5, 6 which are produced from merely one fold of the tube 1, proceeding from the longitudinal side edges. The top bag wall 2 is folded back on its itself about a central fold line 7 through the corner tuck, whilst the bottom bag wall 2 continues through the corner tuck 5, 6 and forms the other half of the bottom material. Bottom flaps 9, 10, which are foldable towards each other about the fold line 8, separate two fold lines 8 that extend parallel to the fold line 7. In this case, the bottom flaps 9, 10 rest by way of the regions 11, hatched in the drawing, on the central region of the corner tucks 5, 6. Consequently, the regions 11 can be provided with an application of the adhesive for producing the bottom.

On the bottom 4 which is represented on the left in the drawing and is provided with a valve opening as valve bottom, there is located on the outer bottom flap 10 a bottom cover sheet 12, which is glued-on on the outside and is realized in a rectangular manner with a length which corresponds to the length of the bottom of the bag when, through its filling process, it is brought into a substantially rectangular cuboid shape.

In the exemplary embodiment represented, a valve opening 13 is realized between the corner tuck 6 and the bottom flaps 9, 10 by dispensing with an adhesive connection between the corner tuck 6 and the two bottom flaps 9, 10 in the region of the valve opening 13. The connection of the bottom flaps 9, 10, in this case, is ensured by the glued-on bottom cover sheet 12.

The bottom cover sheet 12 is provided over its length, which corresponds to the width of the subsequent bag, with a strip 14, which engages the adjacent bag wall over the fold line 8 lying remote from the bottom cover sheet 12 and there is glued over the entire surface with an application of the adhesive. This bonding is not effected until the bottom flaps 9, 10 have already been folded-in such that the strip 14 projects over the folded bottom 4.

It can be seen that the application of the adhesive is effected on the bottom 3, which is not provided with the valve opening 3, in a manner other than that for the bottom 4, which forms the valve opening 13. Usually, the valve opening is formed by an inserted, folded valve slip. The bag according to the invention preferably dispenses with this.

An embodiment of the bottom as is described in EP 1 914 173 B1 can be used as an alternative to the described bag structure. In the case of said bottom, the valve opening is situated between the bottom flaps 9, 10 and the bottom cover sheet 12. The bottom flaps, in this case, have no degree of overlap or just a slight degree of overlap.

According to the invention, at least the critical application of the adhesive for the bottom 4, which is provided with the valve opening 13, is carried out using a dextrin adhesive, preferably maltodextrin. It is particularly preferred if the other bottom 3 is also bonded using a dextrin adhesive. Obviously, the longitudinal seam for forming the tube 1 from the flat material of the bag wall 2 can also be formed using the dextrin adhesive—preferably maltodextrin.

The bag shown is suited, in particular, as a cement bag, which can be thrown into the concrete mixer in the closed form with its cement contents because there, in the slightly moist environment which is formed by water and sand, preferably provided with gravel, it. To this end, the bag wall 2 consists of water-soluble paper that is known per se, only contains a small amount of starch and is used as non-sized paper.

The bags according to the invention are also suitable for filling with fibrous materials which are added to concrete, screeding or the like. The water-soluble bag according to the invention can also be used for these applications as it dissolves completely in a manner that is not detrimental to the final mixture. Also for the adding of fibrous materials to mixtures that are to harden, the advantage produced is that the pouring out of the fibrous materials into the mixing device is avoided, which means that it is possible to avoid the contamination caused by fine dusts and in particular by fine fiber portions that give cause for concern for health.

The invention claimed is:

1. A bag comprising:

a single-layer or multi-layer bag wall, which is bonded to form a tube wherein at least one end of said tube has a bottom that is suitable for filling with charge through a filler of a bag-filling machine, wherein said bottom is folded and bonded with dextrin adhesive that is maltodextrin having a dextrose equivalent of 4.5 to 8.5, wherein at least one end of said tube includes a valve opening, and wherein said bag wall is made from a material which dissolves in a moist environment to release the charge.

2. The bag according to claim 1, wherein said bottom includes bottom flaps which overlap by a maximum of 1 cm and are covered by a bottom cover sheet, said bottom flaps are configured for folding to form the bottom, and wherein the valve opening is between the bottom flaps and the bottom cover sheet.

3. The bag according to claim 1, further comprising bottom flaps which overlap above a corner tuck of the bottom and together with the corner tuck form the valve opening.

4. The bag according to claim 1, wherein said valve opening does not include a folded valve sheet.

5. The bag according to claim 2 wherein a width of the bottom cover sheet is greater than that of the bottom and said bottom cover sheet extends over a bottom fold line to an adjacent bag wall.

6. A method of making concrete, comprising the steps of:

obtaining cement in a bag having a single-layer or multi-layer bag wall, which is bonded to form a tube wherein at least one end of said tube has a bottom that is suitable for filling with charge through a filler of a bag-filling machine, wherein said bottom is folded and bonded with dextrin adhesive that is maltodextrin having a dextrose equivalent of 4.5 to 8.5, wherein at least one end of said tube includes a valve opening, and wherein said bag wall is made from a material which dissolves in a moist environment to release the charge; and dissolving the bag wall in a concrete mixing machine with water and sand as aggregates.

7. The method according to claim 6 wherein said dissolving step includes gravel as a further aggregate.

* * * * *